US010012944B2

(12) United States Patent
Toyama et al.

(10) Patent No.: US 10,012,944 B2
(45) Date of Patent: Jul. 3, 2018

(54) METHOD FOR MANUFACTURING CLEANING BLADE, CLEANING BLADE, IMAGE FORMATION DEVICE, AND PROCESS CARTRIDGE

(71) Applicants: Kaori Toyama, Kanagawa (JP); Shinji Nohsho, Tokyo (JP); Masanobu Gondoh, Kanagawa (JP); Shohei Gohda, Kanagawa (JP); Masahiro Ohmori, Kanagawa (JP); Yohta Sakon, Kanagawa (JP); Hiromi Sakaguchi, Kanagawa (JP)

(72) Inventors: Kaori Toyama, Kanagawa (JP); Shinji Nohsho, Tokyo (JP); Masanobu Gondoh, Kanagawa (JP); Shohei Gohda, Kanagawa (JP); Masahiro Ohmori, Kanagawa (JP); Yohta Sakon, Kanagawa (JP); Hiromi Sakaguchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/124,095

(22) PCT Filed: Mar. 24, 2015

(86) PCT No.: PCT/JP2015/058801
§ 371 (c)(1),
(2) Date: Sep. 7, 2016

(87) PCT Pub. No.: WO2015/156110
PCT Pub. Date: Oct. 15, 2015

(65) Prior Publication Data

US 2017/0017194 A1 Jan. 19, 2017

(30) Foreign Application Priority Data

Apr. 9, 2014 (JP) ..... 2014-080394

(51) Int. Cl.
*G03G 21/00* (2006.01)
*G03G 21/18* (2006.01)

(52) U.S. Cl.
CPC ..... *G03G 21/0017* (2013.01); *G03G 21/1814* (2013.01)

(58) Field of Classification Search
None
See application file for complete search history.

(56) References Cited

U.S. PATENT DOCUMENTS 4,976,992 A * 12/1990 Chino ..... B05D 1/32 427/131
2005/0244274 A1* 11/2005 Wustman ..... C23F 1/44 416/241 R (Continued)

FOREIGN PATENT DOCUMENTS

JP 2004-046145 2/2004
JP 2004-280086 10/2004

(Continued)

OTHER PUBLICATIONS

International Search Report dated Jun. 16, 2015 for counterpart International Patent Application No. PCT/JP2015/058801 filed Mar. 24, 2015, Text Not Considered.

(Continued)

*Primary Examiner* — Sevan A Aydin
(74) *Attorney, Agent, or Firm* — Cooper & Dunham LLP

(57) ABSTRACT

A method for producing a cleaning blade including at least a strip-shaped elastic blade, the method including: (1) a step of producing an elastic blade preform formed of a polyurethane rubber; (2) a step of impregnating at least a part, which is to contact an image bearer, of the elastic blade preform with an ultraviolet-curable composition including a (meth) acrylate compound; (3) a step of immersing the part impregnated of the elastic blade preform in a washing solvent to (Continued)

remove the ultraviolet-curable composition including the (meth)acrylate compound remaining on a surface of the impregnated part; and (4) a step of curing the ultraviolet-curable composition including the (meth)acrylate compound that has impregnated the elastic blade preform to produce an elastic blade.

6 Claims, 6 Drawing Sheets

(56) References Cited

U.S. PATENT DOCUMENTS

| | | | | |
|---|---|---|---|---|
| 2006/0201910 | A1* | 9/2006 | Getty | B29C 59/14 216/57 |
| 2008/0047579 | A1* | 2/2008 | Ji | B08B 7/0035 134/1.1 |
| 2011/0135361 | A1 | 6/2011 | Kabata et al. | |
| 2014/0178103 | A1 | 6/2014 | Gohda et al. | |
| 2015/0248101 | A1* | 9/2015 | Hayashi | C08G 77/38 430/105 |
| 2015/0325441 | A1* | 11/2015 | Tai | H01L 21/0206 438/694 |

FOREIGN PATENT DOCUMENTS

| | | |
|---|---|---|
| JP | 2007-052062 | 3/2007 |
| JP | 2009-244761 | 10/2009 |
| JP | 2010-032703 | 2/2010 |
| JP | 2010-170157 | 8/2010 |
| JP | 2012-058528 | 3/2012 |
| JP | 2013-76970 | 4/2013 |
| JP | 2014-142597 | 8/2014 |

OTHER PUBLICATIONS

Korean official action (and English translation thereof) dated Nov. 10, 2017 in connection with corresponding Korean patent application No. 10-2016-7030979.

* cited by examiner

METHOD FOR MANUFACTURING CLEANING BLADE, CLEANING BLADE, IMAGE FORMATION DEVICE, AND PROCESS CARTRIDGE

TECHNICAL FIELD

The present invention relates to a method for producing a cleaning blade, a cleaning blade, an image forming device, and a process cartridge.

BACKGROUND ART

Hitherto, electrophotographic image forming devices have used cleaning devices, which are cleaning means, to remove unnecessary untransferred residual toner adhering on surfaces of image bearers such as photoconductors, which are cleaning target members, after toner images are transferred onto transfer paper or intermediate transfer media.

Well-known cleaning devices use strip-shaped elastic blades as cleaning members, because the strip-shaped elastic blades can typically make the configurations simple and have excellent cleaning performances. Each of the elastic blades is formed of an elastic body such as a polyurethane rubber. With a base end of the elastic blade supported on a supporting member, a projecting end edge portion is pressed against a peripheral surface of the image bearer to block, scrape off, and remove toner remaining on the image bearer.

With the elastic blade formed of polyurethane, however, as illustrated in FIG. 6A, a frictional force between an image bearer 123 and a cleaning blade 62 increases to draw the cleaning blade 62 in a direction in which the image bearer 123 is moved, to cause a projecting end edge portion 62*c* of the cleaning blade 62 to curl. When cleaning is continued in the state that the projecting end edge portion 62*c* of the cleaning blade 62 is curling, a local wear occurs at a position that is on a blade projecting end surface 62*a* of the cleaning blade 62 and is apart from the projecting end edge portion 62*c* by some micrometers as illustrated in FIG. 6B. When cleaning is further continued in this state, the local wear grows for the projecting end edge portion 62*c* to be lost finally as illustrated in FIG. 6C. When the projecting end edge portion 62*c* is lost, toner cannot be cleaned well and a cleaning failure may occur. Reference numeral 62*b* denotes a vertical surface on the projecting end edge portion.

Hence, in order to suppress curling of the projecting end edge portion of the cleaning blade, there has been a need to provide the projecting end edge portion with a high hardness to make the projecting end edge portion less deformable. As a method for providing a projecting end with a high hardness, Patent document 1 discloses a method of impregnating a surface and an internal portion of a blade with an ultraviolet-curable resin to provide a high hardness and make the projecting end edge portion less deformable both initially and over time.

As a method for applying an impregnation treatment to provide a surface and an internal portion of an elastic blade with a high hardness, there is a method of impregnating a urethane rubber, which is the base material of the elastic blade, with an ultraviolet-curable resin from a surface of the urethane rubber, removing the resin excessively remaining on the surface of the blade after the impregnation, and then curing the resin by ultraviolet irradiation. In this method, the step of removing the resin excessively remaining on the surface of the blade is performed by an operation of wiping the blade in the longer direction with a solvent. However, the solvent may extract not only the resin on the surface of the urethane rubber but also the resin that has impregnated the internal portion. Because the extracted resin adheres to non-woven fabric soaked with the solvent used for the wiping, the concentration of the resin adhering to the non-woven fabric increases as the wiping goes on, to weaken the capacity for extracting the resin. As a result, the wiping capacity is uneven in the longer direction of the blade to cause a gradient or unevenness in the amount of the resin to remain in the internal portion of the blade, and this has been confirmed to appear as a severe hardness gradient or hardness unevenness after final curing. A blade that has a hardness gradient or hardness unevenness in the longer direction is unable to apply a pressure on an image bearer uniformly in the longer direction and allows part of toner to slip through, to cause a cleaning failure. Further, the impregnated resin is extracted in a large amount when kept for a long time in contact with the solvent used for the wiping, to fail in providing a high hardness even if the resin is cured. This causes the projecting end edge portion to curl, leading to slip-through of toner and a cleaning failure.

Furthermore, as described in Patent documents 2 and 3, a cleaning blade produced through impregnation and a curing treatment has protrusions on a surface of the cured layer unless the residue on the surface of the blade is uniformly removed after the impregnation treatment. While cleaning residual toner on an image bearer, such a cleaning blade allows the toner to slip through from around the protrusions, to cause a cleaning failure. After impregnation of an isocyanate compound, Patent document 2 employs a step of blowing hot air to blow away an excessive portion of the isocyanate compound and further wiping off the isocyanate compound with a solvent for sufficient removal. Not only is the treatment with hot air alone insufficient, but wiping off with a solvent produces a hardness difference in the longer direction of the blade as described above.

CITATION LIST

Patent Document

Patent document 1: Japanese Patent Application No. 2012-282844

Patent document 2: Japanese Unexamined Patent Application Publication No. 2004-280086

Patent document 3: Japanese Unexamined Patent Application Publication No. 2007-52062

SUMMARY OF INVENTION

Technical Problem

The present invention has been made in view of the background described above and has an object to provide a method for producing a cleaning blade including at least a strip-shaped elastic blade, the method being able to overcome a cleaning failure that may occur due to a hardness difference in the longer direction of the elastic blade and protrusions on the surface of the elastic blade.

Solution to Problem

A method for producing a cleaning blade according to the present invention is a method for producing a cleaning blade including at least a strip-shaped elastic blade, the method including:

(1) a step of producing an elastic blade preform formed of a polyurethane rubber;

(2) a step of impregnating at least a part, which is to contact an image bearer, of the elastic blade preform with an ultraviolet-curable composition including a (meth)acrylate compound;

(3) a step of immersing the part impregnated of the elastic blade preform in a washing solvent to remove the ultraviolet-curable composition including the (meth)acrylate compound remaining on a surface of the part impregnated; and (4) a step of curing the ultraviolet-curable composition including the (meth)acrylate compound that has impregnated the elastic blade preform to produce an elastic blade.

Effects of Invention

The method for producing a cleaning blade according to the present invention impregnates a surface of an elastic blade preform with an ultraviolet-curable composition including a (meth)acrylate compound, and then removes an excessive portion of the ultraviolet-curable composition remaining on the surface of the elastic blade preform by immersion in a washing solvent for a certain time. This enables the ultraviolet-curable composition to be removed uniformly in the longer direction of the blade, making it possible to suppress slip-through of toner and overcome a cleaning failure.

MODE FOR CARRYING OUT THE INVENTION

Figure 1A:
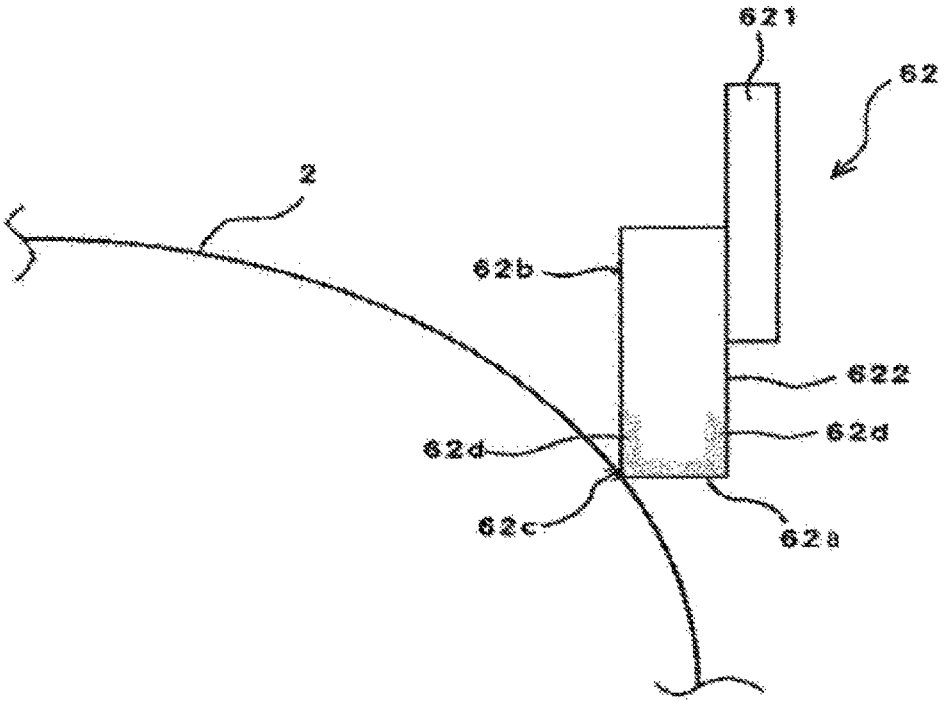
FIG. 1A is an enlarged cross-sectional view of a cleaning blade, illustrating a state that the cleaning blade contacts a surface of a photoconductor.

A method for producing a cleaning blade according to the present invention is a method for producing a cleaning blade including at least a strip-shaped elastic blade, the method including:

(1) a step of producing an elastic blade preform formed of a polyurethane rubber;

(2) a step of impregnating at least a part, which is to contact an image bearer, of the elastic blade preform with an ultraviolet-curable composition including a (meth)acrylate compound;

(3) a step of immersing the part impregnated of the elastic blade preform in a washing solvent to remove the ultraviolet-curable composition including the (meth)acrylate compound remaining on a surface of the part impregnated; and (4) a step of curing the ultraviolet-curable composition including the (meth)acrylate compound that has impregnated the elastic blade preform to produce an elastic blade.

A surface of the elastic blade preform is impregnated with the ultraviolet-curable composition including the (meth) acrylate compound, and then an excessive portion of the ultraviolet-curable composition remaining on the surface of the elastic blade preform is removed by immersion in a washing solvent for a certain time. This enables the ultraviolet-curable composition to be removed uniformly in the longer direction of the elastic blade preform.

The washing solvent used in the present invention needs to dissolve the ultraviolet-curable composition remaining on the surface of the elastic blade preform and remove the ultraviolet-curable composition from the surface. Therefore, it is desirable that a SP value of the washing solvent be close to 9.5, which is the SP value of common acrylic resins, and that the washing solvent be highly compatible with the ultraviolet-curable composition. Specifically, it is preferable that the SP value of the washing solvent be 8.0 or greater but 11.5 or less.

In the present invention, "solubility parameter (SP) value" is a value defined based on the regular solution theory introduced by Hildebrand and functions as an indicator of solubility of a binary solution. The parameter value itself is presented as a standard indicating an intermolecular force. Hence, polar compounds such as water are raised as examples of substances having a high SP value, and hydrophobic compounds are raised as examples of substances having a low SP value.

However, a solvent that can dissolve the ultraviolet-curable composition also extracts the ultraviolet-curable composition that has impregnated an internal portion of a rubber, to make it impossible for a stable cured layer to be formed on the surface. As a result, there is a fear that unevenness may occur in the hardness of the surface. Hence, it is preferable that a solvent used for washing be a solvent that has a high viscosity and is not capable of easily soaking into an internal portion of the elastic blade preform. The viscosity of the solvent at 20° C. is preferably 0.9 [mPa·s] or greater and more preferably 23 [mPa·s] or less.

The viscosity of the solvent can be measured according to a typical method, and can be measured with, for example, a viscometer available from Brooklyn, using a spindle.

A solvent having a lower vapor pressure is lower in the speed of impregnating an internal portion of a urethane rubber, resulting in a lower amount of solvent soaking into an internal portion of the elastic blade. This makes it possible to further suppress extraction of the resin from the internal portion of the elastic blade preform. Therefore, a solvent having a low vapor pressure is preferable. Specifically, a vapor pressure of the solvent at 20° C. is preferably 15 [kPa] or less and more preferably 0.1 [kPa] or greater.

Furthermore, a washing solvent including a compound having a cyclic chemical structure is lower in the speed of soaking into the elastic blade preform. The reason for this is uncertain but is considered to be a greater bulkiness of the cyclic structure compared with, for example, a straight-chain structure to provide a greater hindrance in soaking into an internal portion of the elastic blade preform. Hence, it is preferable that the washing solvent have a cyclic structure, not be able to soak into an internal portion of the elastic blade preform easily, and be less likely to extract the impregnated ultraviolet-curable composition.

Examples of washing solvents that can be preferably used include:

cyclohexane: with a SP value of 8.2, a viscosity (20° C.) of 0.98 mPa·s, and a vapor pressure (20° C.) of 10.4 kPa;

cyclohexanone: with a SP value of 9.9, a viscosity (20° C.) of 1.78 mPa·s, and a vapor pressure (20° C.) of 0.5 kPa;

1-methoxy-2-propanol: with a SP value of 10.4, a viscosity (20° C.) of 1.81 mPa·s, and a vapor pressure (20° C.) of 1 kPa:

1-butanol: with a SP value of 11.4, a viscosity (20° C.) of 3 mPa·s, and a vapor pressure (20° C.) of 0.6 kPa;

methyl ethyl ketone: with a SP value of 9.3, a viscosity (20° C.) of 0.4 mPa·s, and a vapor pressure (20° C.) of 10.5 kPa;

toluene: with a SP value of 8.9, a viscosity (20° C.) of 0.59 mPa·s, and a vapor pressure (20° C.) of 3 kPa;

xylene: with a SP value of 8.8, a viscosity (20° C.) of 0.81 mPa·s, and a vapor pressure (20° C.) of 0.8 kPa;

butyl acetate: with a SP value of 8.5, a viscosity (20° C.) of 0.74 mPa·s, and a vapor pressure (20° C.) of 1.3 kPa;

tetrahydrofuran: with a SP value of 9.1, a viscosity (20° C.) of 0.49 mPa·s, and a vapor pressure (20° C.) of 20 kPa;

acetone: with a SP value of 9.9, a viscosity (20° C.) of 0.32 mPa·s, and a vapor pressure (20° C.) of 22 kPa;

ethanol: with a SP value of 12.7, a viscosity (20° C.) of 1.2 mPa·s, and a vapor pressure (20° C.) of 5.9 kPa;

diethyl ether: with a SP value of 7.4, a viscosity (20° C.) of 0.24 mPa·s, and a vapor pressure (20° C.) of 58.6 kPa; and ethylene glycol: with a SP value of 14.2, a viscosity (20° C.) of 23.5 mPa·s, and a vapor pressure (20° C.) of 0.07 kPa.

Cyclohexane and cyclohexanone are particularly preferable.

One kind of a washing solvent may be used or two or more kinds of washing solvents may be used as a mixture.

After the immersion in the washing solvent, there may be an additional step of removing the solvent remaining on the elastic blade preform. Examples of a removing method include, but are not limited to, air drying, a method of absorbing the solvent into non-woven fabric or a sponge, a method of sliding a member such as glass on the elastic blade preform, and removal by rubbing off.

A cleaning blade of the present invention is a cleaning blade including at least a strip-shaped elastic blade. The elastic blade includes an impregnated part impregnated with an ultraviolet-curable composition including a (meth)acrylate compound and cured with ultraviolet rays, the impregnated part being at at least a part, which is to contact an image bearer, of an elastic blade preform formed of a polyurethane rubber. The elastic blade has unevenness of 35 [%] or less in a longer direction of the elastic blade in Martens hardness measured from surfaces of the elastic blade at positions that are on a horizontal surface and a vertical surface of the impregnated part and are at a distance of 20 [μm] from a projecting end edge portion of the elastic blade. The Martens hardness of the surfaces of the impregnated part of the elastic blade is not particularly limited. However, in order to suppress slip-through of toner, unevenness in the Martens hardness measured from the surfaces at positions that are on the horizontal surface and the vertical surface and are at a distance of 20 μm from the projecting end edge portion needs to be 35% or less and is preferably 30% or less in the longer direction.

The impregnated part of the elastic blade is a part obtained by impregnating an elastic blade preform with an ultraviolet-curable composition including a (meth)acrylate compound and curing the ultraviolet-curable composition.

A side (i.e., projecting end edge portion), which is to contact an image bearer, of the elastic blade is divided into 5 equal parts, and Martens hardness is measured from the surfaces at 5 positions that are within the 5 equal parts on each of the horizontal surface and the vertical surface of the impregnated part of the elastic blade and are at a distance of 20 μm from the projecting end edge portion (i.e., a total of 10 positions). The value representing the unevenness in Martens hardness in the longer direction is obtained by calculating an average of the 5 positions on each of the horizontal surface and the vertical surface and calculating the maximum deviation from the average in percentage.

The horizontal surface refers to a projecting end surface of the elastic blade including the projecting end edge portion and facing a surface of an image bearer on an upstream side in a moving direction of the image bearer. The vertical surface refers to a surface including the projecting end edge portion and facing a surface of the image bearer on a downstream side in the moving direction of the image bearer.

Figure 4:
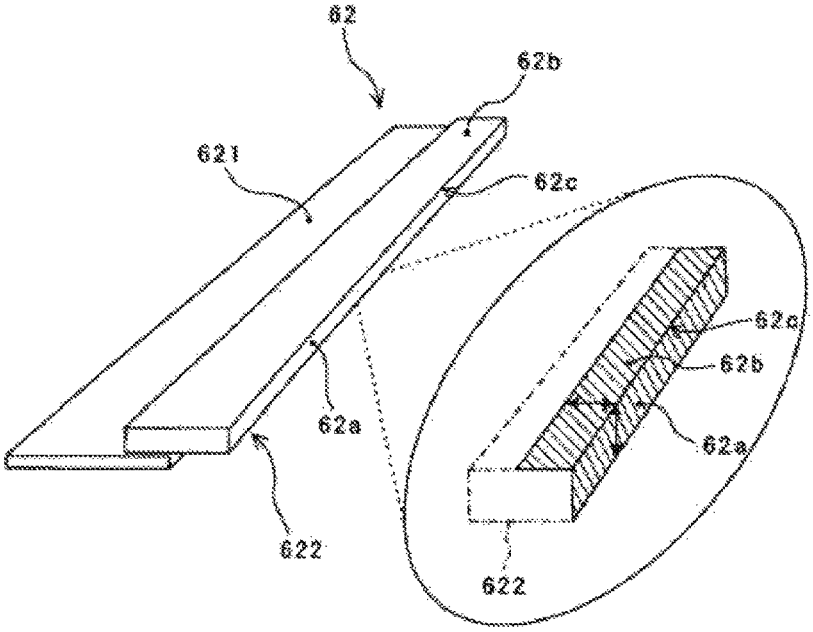
FIG. 4 is a perspective view of a cleaning blade according to an embodiment of the present invention.
Figure 5:
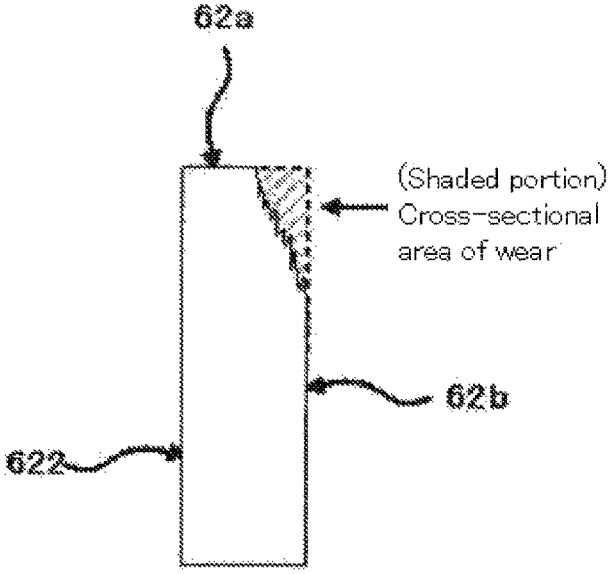
FIG. 5 is an exemplary view illustrating a portion, where a width of wear is measured, of an elastic blade.
Figure 6A:
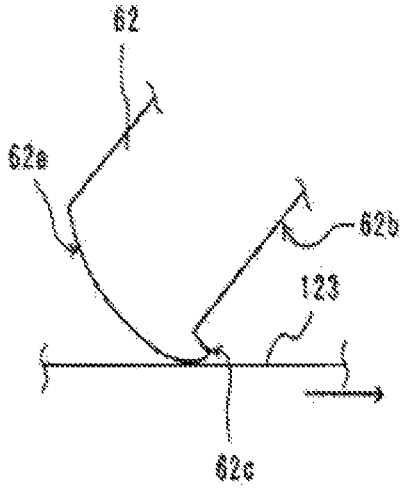
FIG. 6A is a view illustrating a state that a projecting end edge portion of a cleaning blade curls.
Figure 6B:
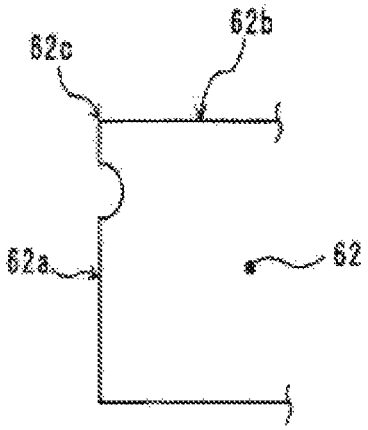
FIG. 6B is a view illustrating a local wear of a projecting end surface of a cleaning blade.
Figure 6C:
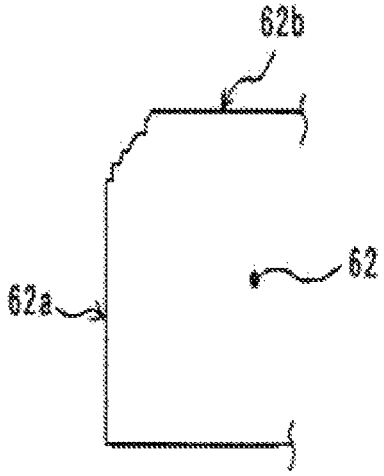
FIG. 6C is a view illustrating a state that a projecting end edge portion of a cleaning blade is lost.

FIG. 4 is a perspective view of a cleaning blade 62. FIG. 5 is an enlarged cross-sectional view of the cleaning blade 62.

The cleaning blade 62 includes a strip-shaped holder 621 formed of a stiff material such as a metal or a hard plastic and a strip-shaped elastic blade 622.

The elastic blade 622 is secured to one end side of the holder 621 with, for example, an adhesive. The other end side of the holder 621 is cantilevered on a case of a cleaning means 3.

It is preferable that the elastic blade 622 have a high impact resilience in order to be able to conform to decentering of a photoconductor 2 and minute ridges on a surface of the photoconductor.

In FIG. 4, reference numeral 62*a* denotes a projecting end surface (i.e., the horizontal surface mentioned above), and reference numeral 62*b* denotes the vertical surface on the projecting end edge portion.

(Step of Producing Elastic Blade Preform Formed of Polyurethane Rubber)

The elastic blade preform formed of a polyurethane rubber is not particularly limited and may be appropriately selected depending on the intended purpose. For example, the elastic blade preform is produced by preparing a polyurethane prepolymer using a polyol compound and a polyisocyanate compound, adding a hardener, and as needed, a hardening catalyst to the polyurethane prepolymer, allowing the polyurethane prepolymer to undergo crosslinking in a predetermined mold, allowing the resultant to undergo post-crosslinking in a furnace, molding the resultant into a sheet shape by centrifugal molding, leaving the resultant to stand at normal temperature for aging, and cutting the resultant into a strip shape having a predetermined size.

The polyol compound is not particularly limited and may be appropriately selected depending on the intended purpose. Examples of the polyol compound include high-molecular-weight polyols and low-molecular-weight polyols.

Examples of the high-molecular-weight polyols include: polyester polyols, which are condensation products of alkylene glycols and aliphatic dibasic acid; polyester-based polyols such as polyester polyols of alkylene glycols and adipic acid, such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone-based polyols such as polycaprolactone ester polyol obtained by ring-opening-polymerizing caprolactone; and polyether-based polyols such as poly(oxytetramethylene)glycol and poly(oxypropylene)glycol. One of these high-molecular-weight polyols may be used alone or two or more of these high-molecular-weight polyols may be used in combination.

Examples of the low-molecular-weight polyols include: divalent alcohols such as 1,4-butanediol, ethylene glycol, neopentyl glycol, and hydroquinone-bis(2-hydroxyethyl) ether; and trivalent or higher polyvalent alcohols such as 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. One of these low-molecular-weight polyols may be used alone or two or more of these low-molecular-weight polyols may be used in combination.

The polyisocyanate compound is not particularly limited and may be appropriately selected depending on the intended purpose. Examples of the polyisocyanate compound include methylene diphenyl diisocyanate (MDI), tolylene diisocyanate (TDI), xylylene diisocyanate (XDI), naphtylene-1,5-diisocyanate (NDI), tetramethylxylene diisocyanate (TMXDI), isophorone diisocyanate (IPDI), hydrogenated xylylene diisocyanate ($H_6$XDI), dicyclohexylmethane diisocyanate ($H_{12}$MDI), hexamethylene diisocyanate (HDI), dimer acid diisocyanate (DDI), norbornene diisocyanate (NBDI), and trimethylhexamethylene diisocyanate (TMDI). One of these polyisocyanate compounds may be used alone or two or more of these polyisocyanate compounds may be used in combination.

The hardening catalyst is not particularly limited and may be appropriately selected depending on the intended purpose. Examples of the hardening catalyst include 2-methylimidazole and 1,2-dimethylimidazole.

An amount of the hardening catalyst to be used is not particularly limited and may be appropriately selected depending on the intended purpose. However, the amount of hardening catalyst to be used is preferably from 0.01% by mass through 0.5% by mass and more preferably from 0.05% by mass through 0.3% by mass of the polyurethane prepolymer.

The elastic blade preform may be a two-layered type in which two different materials are laminated.

Figure 1B:
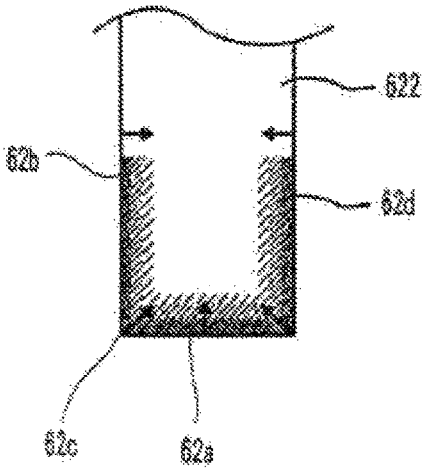
FIG. 1B is an enlarged cross-sectional view of a cleaning blade, illustrating a portion of the cleaning blade 62 at and around a projecting end edge portion 62*c* in an enlarged state.

FIG. 1A and FIG. 1B are enlarged cross-sectional views of the cleaning blade 62. FIG. 1A is a view illustrating a state that the cleaning blade 62 contacts a surface of the photoconductor 2. FIG. 1B is an enlarged view illustrating a portion of the cleaning blade 62 at and around a projecting end edge portion 62*c*.

The elastic blade 622 is obtained by impregnating at least a part, which is to contact an image bearer, of the elastic blade preform with an ultraviolet-curable composition including a (meth)acrylate compound. The projecting end edge portion 62*c*, which is the part to contact an image bearer, is subjected to an impregnation treatment described in detail below.

Reference numeral 62*d* denotes an impregnation range.

As hardness of the elastic blade preform of the elastic blade 622, it is preferable that a tan δ peak temperature of the rubber measured with, for example, DMS6100 available from SII NanoTechnology Inc. be 0 [° C.] or higher, and that difference between hardness (JIS-A) at 23 [° C.] and hardness (JIS-A) at 10 [° C.] be 5 degrees or greater.

(Step of Impregnating at Least Part, to Contact Image Bear, of the Elastic Blade Preform with Ultraviolet-Curable Composition Including (Meth)Acrylate Compound)

It is preferable that the part, which is to contact an image bearer, of the elastic blade preform be the projecting end edge portion of the elastic blade. In the step, for example, the elastic blade preform is impregnated with the ultraviolet-curable composition including the (meth)acrylate compound in a manner that the impregnation treatment is applied to the projecting end edge portion.

It is possible to apply the impregnation treatment to the projecting end edge portion 62*c* of the elastic blade 622, by performing impregnation of the ultraviolet-curable composition including the (meth)acrylate compound by, for example, brushing, spray coating, and dip coating.

The impregnation treatment needs to be applied at least to the projecting end edge portion, but it is preferable that impregnation be applied up to a distance of 0.5 mm or greater from the projecting end edge portion on both of the horizontal surface and the vertical surface. In FIG. 1B, a lower end of the elastic blade 622 including the projecting end edge portion 62*c* is impregnated. However, this is non-limiting. It is only needed that the impregnation treatment be applied up to a distance of 0.5 mm or greater from the projecting end edge portion 62*c* on both of the projecting end surface 62*a* (i.e., the horizontal surface) and the vertical surface 62*b* on the projecting end edge portion. It is more preferable that the impregnation treatment be applied up to a distance in a range of from 0.5 mm or greater but 1 cm or less from the projecting end edge portion. If the impregnation treatment is applied up to a distance greater than 1 cm, elasticity may be lost.

An impregnation time is preferably from 5 minutes through 60 minutes. A temperature during impregnation is preferably from 10° C. through 35° C.

A (meth)acrylate compound that can be used has a molecular weight of from 100 through 1,500.

The (meth)acrylate compound having a molecular weight of from 100 through 1,500 is not particularly limited and may be appropriately selected depending on the intended purpose. Examples of the (meth)acrylate compound having a molecular weight of from 100 through 1.500 include dipentaerythritol hexa(meth)acrylate, pentaerythritol tetra (meth)acrylate, pentaerythritol tri(meth)acrylate, pentaerythritol ethoxy tetra(meth)acrylate, trimethylolpropane tri(meth)acrylate, trimethylolpropane ethoxy tri(meth)acrylate, 1,6-hexanediol di(meth)acrylate, ethoxylated bisphenol A di(meth)acrylate, propoxylated ethoxylated bisphenol A di(meth)acrylate, 1,4-butanediol di(meth)acrylate, 1,5-pentanediol di(meth)acrylate, 1,6-hexanediol di(meth)acrylate, 1,7-heptanediol di(meth)acrylate, 1,8-octanediol di(meth) acrylate, 1,9-nonanediol di(meth)acrylate, 1,10-decanediol di(meth)acrylate, 1,11-undecanediol di(meth)acrylate, 1,18-octadecanediol di(meth)acrylate, glycerin propoxy tri(meth) acrylate, dipropylene glycol di(meth)acrylate, tripropylene glycol di(meth)acrylate, PO-modified neopentyl glycol di(meth)acrylate, PEG 600 di(meth)acrylate, PEG 400 di(meth)acrylate, PEG 200 di(meth)acrylate, neopentyl glycol/hydroxypivalic acid ester di(meth)acrylate, octyl/decyl (meth)acrylate, isobornyl (meth)acrylate, and ethoxylated phenyl (meth)acrylate, and 9,9-bis[4-(2-(meth)acryloyloxyethoxy)phenyl]fluorene. One of these (meth)acrylate compounds may be used alone or two or more of these (meth) acrylate compounds may be used in combination. Among these (meth)acrylate compounds, compounds having a pentaerythritol triacrylate structure including from 3 through 6 functional groups are preferable.

Examples of the compounds having a pentaerythritol triacrylate structure including from 3 through 6 functional groups include pentaerythritol triacrylate and dipentaerythritol hexaacrylate.

As described in Japanese Unexamined Patent Application Publication No. 2014-142597, it is possible to provide the projecting end with a higher hardness by mixing acrylate or methacrylate having a tricyclodecane or adamantane skeleton having a high hardness and a high elasticity. Although having a small number of functional groups, the tricyclodecane or adamantane skeleton can compensate for shortage of crosslinking points by a special structure of the skeleton and can achieve a high hardness and a high elasticity even in an internal portion of the elastic body when impregnated. A high hardness can prevent deformation of the projecting end of the cleaning blade and a high elasticity can ensure conformability to a photoconductor. Examples of the acrylate or methacrylate having a tricyclodecane or adamantane skeleton include tricyclodecane dimethanol diacrylate, 1,3-adamantane dimethanol diacrylate, 1,3-adamantane dimethanol dimethacrylate, 1,3,5-adamantane trimethanol triacrylate, and 1,3,5-adamantane trimethanol trimethacrylate. Two or more of these acrylates or methacrylates may be used as a mixture.

The number of functional groups of the acrylate or methacrylate having a tricyclodecane or adamantane skeleton is preferably from 1 through 6 and more preferably from 2 through 4. A crosslinked structure is weak with only 1 functional group, whereas steric hindrance may occur with 5 or more functional groups. Therefore, it is preferable to mix acrylates or methacrylates having different numbers of functional groups.

Other components are not particularly limited and may be appropriately selected depending on the intended purpose. Examples of other components include a photopolymerization initiator, a polymerization inhibitor, and a diluent.

The photopolymerization initiator is not particularly limited and may be appropriately selected depending on the intended purpose so long as the photopolymerization initiator generates active species such as radicals and cations under light energy to initiate polymerization. Examples of the photopolymerization initiator include photoradical polymerization initiators and photocation polymerization initiators. Among these photopolymerization initiators, photoradical polymerization initiators are particularly preferable.

Examples of the photoradical polymerization initiators include aromatic ketones, acylphosphine oxide compounds, aromatic onium salt compounds, organic peroxides, thio compounds (e.g., thioxanthone compounds and thiophenyl group-including compounds), hexaaryl biimidazole compounds, ketoxime ester compounds, borate compounds, azinium compounds, metallocene compounds, active ester compounds, compounds including a carbon-halogen bond, and alkylamine compounds.

The photoradical polymerization initiator is not particularly limited and may be appropriately selected depending on the intended purpose. Examples of the photoradical polymerization initiator include acetophenone, acetophenone benzyl ketal, 1-hydroxycyclohexylphenyl ketone, 2,2-dimethoxy-2-phenyl acetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropan-1-one, 2-hydroxy-2-methyl-1-phenylpropan-1-one, thioxanthone, diethyl thioxanthone, 2-isopropyl thioxanthone, 2-chlorothioxanthone, 2-methyl-1-[4-(methylthio)phenyl]-2-morpholino-propan-1-one, bis(2,4,6-trimethylbenzoyl)-phenylphosphine oxide, 2,4,6-trimethylbenzoyl-diphenyl-phosphine oxide, 2,4-diethyl thioxanthone, and bis-(2,6-dimethoxybenzoyl)-2,4,4-trimethylpentylphosphine oxide. One of these photoradical polymerization initiators may be used alone or two or more of these photoradical polymerization initiators may be used in combination.

The photoradical polymerization initiator may be a commercially available product. Examples of the commercially available product include: IRGACURE 651, IRGACURE 184, DAROCUR 1173, IRGACURE 2959, IRGACURE 127, IRGACURE 907, IRGACURE 369, IRGACURE 379, DAROCUR TPO, IRGACURE 819, IRGACURE 784, IRGACURE OXE 01, IRGACURE OXE 02, and IRGACURE 754 (all available from Ciba Specialty Chemicals Inc.); SPEEDCURE TPO (available from Lambson Limited); KAYACURE DETX-S (available from Nippon Kayaku Co., Ltd.); LUCIRIN TPO, LR8893, and LR8970 (all available from BASF GmbH); and EBECRYL P36 (available from UCB Chemicals, Inc.). One of these commercially available products may be used alone or two or more of these commercially available products may be used in combination.

A content of the photopolymerization initiator is not particularly limited and may be appropriately selected depending on the intended purpose. However, the content of the photopolymerization initiator is preferably from 1% by mass through 20% by mass of the ultraviolet-curable composition.

The polymerization inhibitor is not particularly limited and may be appropriately selected depending on the intended purpose. Examples of the polymerization inhibitor include: phenol compounds such as p-methoxyphenol, cresol, t-butylcatechol, di-t-butylparacresol, hydroquinone monomethyl ether, α-naphthol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butylphenol); quinone compounds such as p-benzoquinone, anthraquinone, naphthoquinone, phenanthraquinone, p-xyloquinone, p-toluquinone, 2,6-dichloroquinone, 2,5-diphenyl-p-benzoquinone, 2,5-diacetoxy-p-benzoquinone, 2,5-dicaproxy-p-benzoquinone, 2,5-diacyloxy-p-benzoquinone, hydroquinone, 2,5-dibutylhydroquinone, mono-t-butylhydroquinone, monomethyl hydroquinone, and 2,5-di-t-amylhydroquinone; amine compounds such as phenyl-β-naphthylamine, p-benzylaminophenol, di-β-naphthylparaphenylenediamine, dibenzylhydroxylamine, phenylhydroxylamine, and diethylhydroxylamine; nitro compounds such as dinitrobenzene, trinitrotoluene, and picric acid; oxime compounds such as quinonedioxime and cyclohexanoneoxime; and sulfur compounds such as phenothiazine. One of these polymerization inhibitors may be used alone or two or more of these polymerization inhibitors may be used in combination.

It is preferable that the diluent be capable of dissolving an ultraviolet-curable resin and have a low boiling point. Particularly, it is preferable that the boiling point be 160° C. or lower and more preferably 100° C. or lower. Examples of usable diluents include: hydrocarbon-based solvents such as toluene and xylene; and organic solvents including ester-based types such as ethyl acetate, n-butyl acetate, methylcellosolve acetate, and propylene glycol monomethyl ether acetate, ketone-based types such as methyl ethyl ketone, methyl isobutyl ketone, diisobutyl ketone, cyclohexanone, cyclopentanone, and acetone, ether-based types such as ethylene glycol monomethyl ether, ethylene glycol monoethyl ether, and propylene glycol monomethyl ether, and alcohol-based types such as ethanol, propanol, 1-butanol, isopropyl alcohol, and isobutyl alcohol. One of these diluents may be used alone or two or more of these diluents may be used in combination.

(Step of Immersing Impregnated Part of Elastic Blade Preform in Washing Solvent to Remove Ultraviolet-Curable Composition Including the (Meth)Acrylate Compound Remaining on Surface of the Impregnated Part)

Next, the impregnated part of the elastic blade preform, of which part, which is to contact an image bearer, has been impregnated with the ultraviolet-curable composition including the (meth)acrylate compound is immersed in the washing solvent to remove the ultraviolet-curable composition remaining on the surface of the impregnated part.

It is preferable to immerse at least the region impregnated with the ultraviolet-curable composition in the washing solvent at a temperature equal to or lower than a boiling point of the washing solvent. It is more preferable to perform the immersing treatment at a temperature of from 10° C. through 30° C. It is impossible to determine the treatment time flatly because a washing ability is different depending on the kind of the solvent, but the treatment time is preferably from 1 second or longer but 1 minute or shorter, more preferably within 30 seconds, and particularly preferably within 20 seconds. In order to remove the residue remaining on the surface, contact with the solvent for 1 second or longer is preferable. In order to suppress an amount of the impregnated resin to be extracted, 1 minute or shorter is preferable, because if the immersing time is long, even a solvent that is slow in soaking into the blade extracts the resin that has impregnated the region near the surface of the impregnated part. If the amount of the impregnated resin extracted is high, the resin is not able to provide a high hardness even when cured, to cause the projecting end edge portion to curl.

(Step of Curing Ultraviolet-Curable Composition Including the (Meth)Acrylate Compound that has Impregnated Elastic Blade Preform to Produce Elastic Blade)

Conditions for irradiation of ultraviolet rays used for curing the ultraviolet-curable cured product are not particularly limited and may be appropriately selected depending on the intended purpose. However, a cumulative light volume is preferably from 500 mJ/cm$^2$ through 5,000 mJ/cm$^2$.

An embodiment of the present invention as an application to an electrophotographic printer (hereinafter simply referred to as printer), which is an image forming device, will be described below.

An image forming device of the present invention includes an image bearer, a charging means configured to charge a surface of the image bearer, a latent image forming means configured to form an electrostatic latent image on the surface of the image bearer charged, a developing means configured to develop the electrostatic latent image formed on the surface of the image bearer to form a toner image, a transfer means configured to transfer the toner image on the surface of the image bearer to a transfer medium, and a cleaning means including a cleaning blade configured to contact the surface of the image bearer to clean any untransferred residual toner adhering on the surface of the image bearer. The image forming device uses the cleaning blade of the present invention as the cleaning blade.

Figure 2:
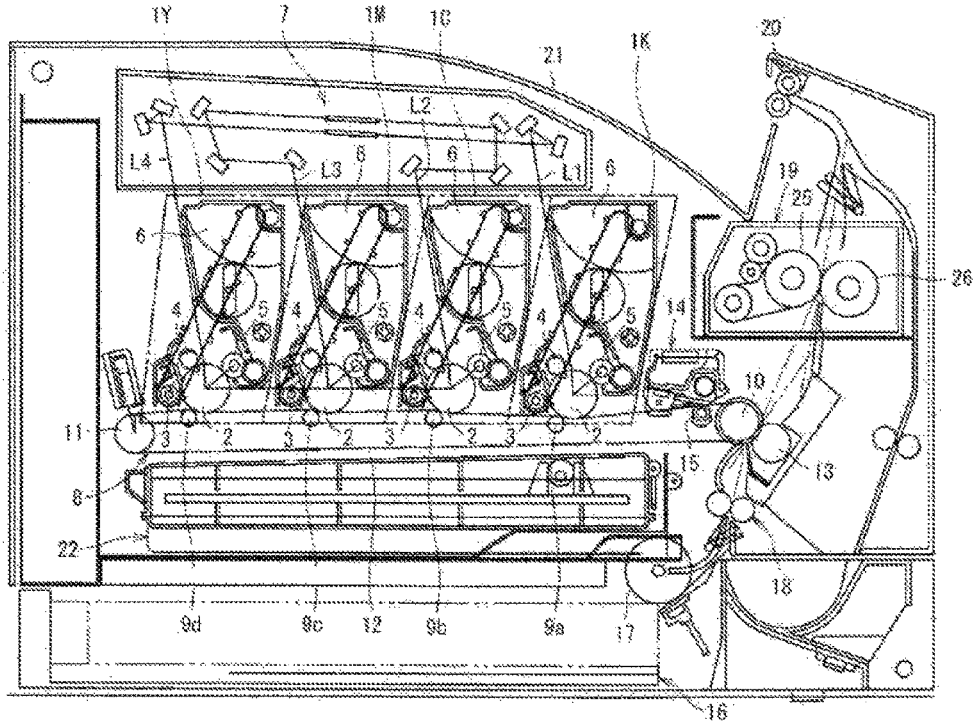
FIG. 2 is a schematic view of a configuration of a printer according to an embodiment of the present invention.

FIG. 2 is an overall configuration view illustrating an overview of the image forming device of the present invention. Main parts of the image forming device will be described below with reference to this drawing.

The image forming device includes four process units 1K, 1C, 1M, and 1Y including image forming units configured to form images using developers of different colors, namely black, cyan, magenta, and yellow corresponding to chromatically separate components of a color image. The process units 1K, 1C, 1M, and 1Y are identical in configuration, except that the process units store toners of different colors from one another. As an example, the configuration of one process unit 1K will be described. The process unit 1K includes an image bearer (photoconductor) 2, a cleaning means 3, a charging means 4, a developing means 5, a toner storing section 6, etc. The process unit 1K is attached in a main body of the image forming device in an attachable/detachable manner. As illustrated in FIG. 2, an exposing device 7 is disposed above the process units 1K, 1C, 1M, and 1Y. The exposing device 7 is configured to emit laser light (L1 through L4) from a laser diode based on image data.

A transfer belt device 8 is disposed below the process units 1K, 1C, 1M, and 1Y. The transfer belt device 8 includes an intermediate transfer belt 12 onto which a toner image formed on the image bearer 2 is transferred. The intermediate transfer belt 12 is passed over four primary transfer rollers 9*a*, 9*b*, 9*c*, and 9*d* facing image bearers 2, a driving roller 10, a tension roller 11, and a cleaning backup roller 15 and configured to be rotatably driven. A secondary transfer roller 13 is disposed counter to the driving roller 10. A belt cleaning device 14 is disposed counter to the cleaning backup roller 15.

A paper feeding cassette 16 capable of storing many sheets and a paper feeding roller 17 configured to send forward a sheet from the paper feeding cassette 16 are disposed in a lower section of the image forming device. A pair of registration rollers 18 configured to stop a sheet once are disposed on the way from the paper feeding roller 17 to a nip between the secondary transfer roller 13 and the driving roller 10.

A fixing device 19 internally including a fixing roller 25, a pressure roller 26, etc. is disposed above the nip between the secondary transfer roller 13 and the driving roller 10. A pair of paper ejecting rollers 20 configured to eject a sheet to the outside are disposed above the fixing device 19. A sheet to be ejected by the pair of paper ejecting rollers 20 is to be stocked on a paper ejecting tray 21 formed by denting a top surface of the main body of the image forming device inward.

A waste toner storing vessel 22 configured to store waste toner is disposed between the transfer belt device 8 and the paper feeding cassette 16. An unillustrated waste toner sending hose extending from the belt cleaning device 14 is coupled to an entrance portion of the waste toner storing vessel 22.

Figure 3:
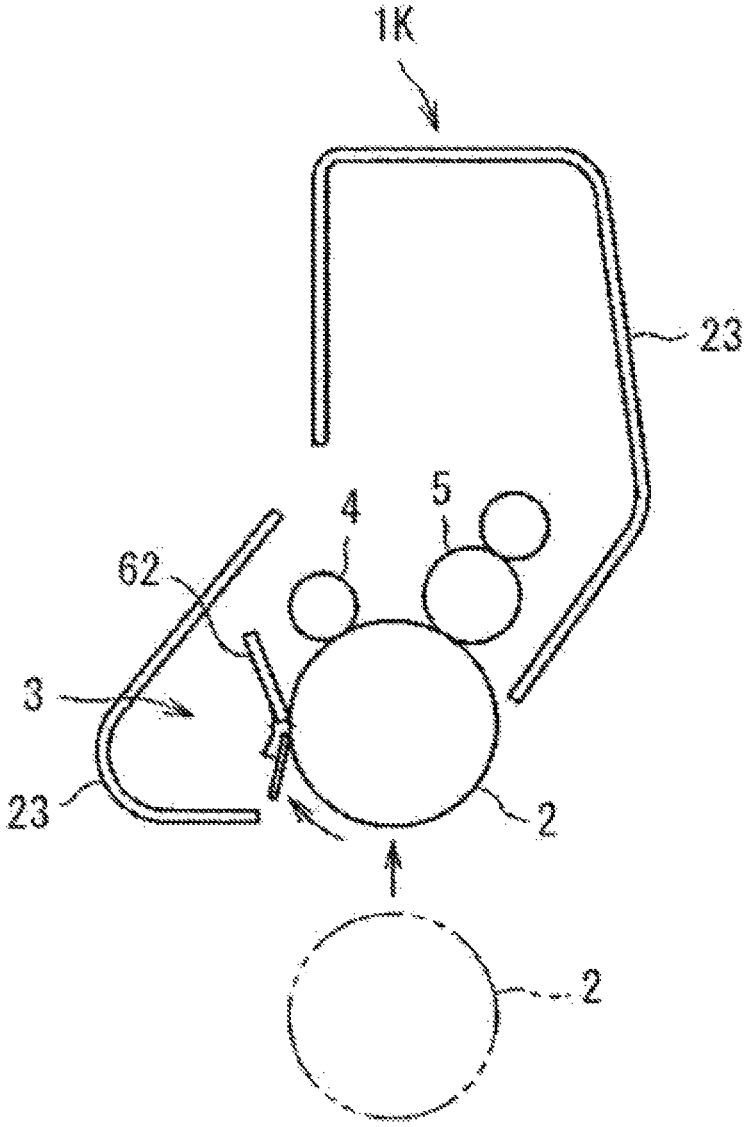
FIG. 3 is a schematic view of a configuration of an image forming unit according to an embodiment of the present invention.

FIG. 3 is a schematic configurational view illustrating a state after the process unit 1K is detached from the main body of the image forming device or before the process unit 1K is attached in the main body. As illustrated in FIG. 3, the process unit includes a housing 23. The housing 23 is formed by injection molding of a resin. Usable examples of the resin include polycarbonate resins, acrylnitrilebutadiene styrene resins, acrylnitrile styrene resins, styrene resins, polyphenylene ether resins, polyphenylene oxide resins, and polyether terephthalate resins, or alloy resins of these resins. The image bearer 2, the cleaning means 3, the charging means 4, the developing means 5, etc. are disposed in the housing 23. The cleaning means includes the cleaning blade of the present invention.

Next, an image forming operation of the printer will be described.

Upon reception of a print executing signal from an unillustrated operating unit or the like, predetermined voltages or currents are applied to the charging means 4 and a developing roller 5 sequentially at predetermined timings. Likewise, predetermined voltages or currents are applied to the exposing device, a charge eliminating lamp, etc. sequentially at predetermined timings. Synchronously, the photoconductor 2 is driven to rotate in an arrow direction in the drawing, by a photoconductor driving motor (unillustrated), which is a driving means.

Upon rotation of the photoconductor 2 in the arrow direction in the drawing, first, a surface of the photoconductor is charged to a predetermined potential by the charging means 4. Then, the photoconductor 2 is irradiated with light L corresponding to an image signal by the exposing device unillustrated. Charges are eliminated from the portion of the photoconductor 2 irradiated with the light L, resulting in formation of an electrostatic latent image.

At a place where the photoconductor 2 on which the electrostatic latent image is formed faces the developing means 5, the surface of the photoconductor 2 is brushed in a sliding manner by a magnetic brush of a developer formed on the developing roller. Here, under a predetermined developing bias applied to the developing roller, negatively charged toner on the developing roller moves toward the electrostatic latent image to form (develop) a toner image. In this way, in the present embodiment, the electrostatic latent image formed on the photoconductor 2 is reversely developed by the toner charged to the negative polarity. In the present embodiment, an example using a contactless charging roller system of an N/P type (negative-positive type of making toner attach to a lower potential side) has been described. However, this is non-limiting.

The toner image formed on the photoconductor 2 is transferred onto a transfer paper sheet fed to a transfer region formed between the photoconductor 2 and a transfer device, which is the transfer means, from a paper feeding section unillustrated via a portion where an upper registration roller and a lower registration roller face each other. Here, for being fed, the transfer paper sheet is made synchronous with a leading end of the image at the portion where the upper registration roller and the lower registration roller face each other. For transfer onto the transfer paper sheet, a predetermined transfer bias is applied. The transfer paper sheet onto which the toner image is transferred is separated from the photoconductor 2 and conveyed to the fixing device, which is a fixing means unillustrated. By being passed through the fixing device, the toner image is fixed on the transfer paper sheet by the action of heat and pressure. The transfer paper sheet is ejected to outside the device.

Meanwhile, toner remaining after the transfer is removed from the surface of the photoconductor 2 after the transfer by the cleaning means 3, and charges on the surface of the photoconductor 2 after the transfer are eliminated by the charge eliminating lamp.

For this printer, the image bearer and at least the cleaning means including the cleaning blade configured to remove untransferred residual toner adhering on the surface of the image bearer may be supported in an integrated manner as a process cartridge that is attachable in and detachable from the main body of the image forming device. In FIG. 3, the image bearer (photoconductor) 2 and the cleaning means 3, the charging means 4, the developing means 5, etc., which are process means, are stored in the housing 23 and made attachable in and detachable from the main body of the device in an integrated manner as a process cartridge. In the present embodiment, the photoconductor 2 and the process means are replaceable in an integrated manner as a process cartridge. However, replacement with a new article may be performed in respective units of the photoconductor 2, the cleaning means 3, the charging means 4, the developing means 5, etc.

The present invention relates to a method for producing a cleaning blade according to [1] below, and includes [2] to [8] below as embodiments.

[1] A method for producing a cleaning blade including at least a strip-shaped elastic blade, the method including:

(1) a step of producing an elastic blade preform formed of a polyurethane rubber;

(2) a step of impregnating at least a part, which is to contact an image bearer, of the elastic blade preform with an ultraviolet-curable composition including a (meth)acrylate compound;

(3) a step of immersing the part impregnated of the elastic blade preform in a washing solvent to remove the ultraviolet-curable composition including the (meth)acrylate compound remaining on a surface of the part impregnated; and (4) a step of curing the ultraviolet-curable composition including the (meth)acrylate compound that has impregnated the elastic blade preform to produce an elastic blade.

[2] The method for producing a cleaning blade according to [1], wherein the washing solvent used in the step (3) has a SP value of 8.0 or greater but 11.5 or less.

[3] The method for producing a cleaning blade according to [1] or [2], wherein the washing solvent used in the step (3) has a viscosity of 0.9 [mPa·s] or greater at 20° C.

[4] The method for producing a cleaning blade according to any one of [1] to [3], wherein the washing solvent used in the step (3) has a vapor pressure of 15 [kPa] or less at 20° C.

[5] The method for producing a cleaning blade according to any one of [1] to [4], wherein the washing solvent used in the step (3) includes a compound having a ring structure.

[6] The method for producing a cleaning blade according to any one of [1] to [5], wherein an immersing time for which the part impregnated of the elastic blade preform is immersed in the washing solvent in the step (3) is within 20 seconds.

[7] A cleaning blade including at least a strip-shaped elastic blade, the elastic blade including an impregnated part impregnated with an ultraviolet-curable composition including a (meth) acrylate compound and cured with ultraviolet rays, the impregnated part being at at least a part, which is to contact an image bearer, of an elastic blade preform formed of a polyurethane rubber, wherein the elastic blade has unevenness of 35 [%] or less in a longer direction of the elastic blade in Martens hardness measured from surfaces of the elastic blade at positions that are on a horizontal surface and a vertical surface of the impregnated part and are at a distance of 20 [μm] from a projecting end edge portion of the elastic blade.

[8] An image forming device including:

an image bearer;

a charging means configured to charge a surface of the image bearer; a latent image forming means configured to form an electrostatic latent image on the surface of the image bearer charged;

a developing means configured to develop the electrostatic latent image formed on the surface of the image bearer to form a toner image;

a transfer means configured to transfer the toner image on the surface of the image bearer onto a transfer medium; and a cleaning means including a cleaning blade configured to contact the surface of the image bearer to clean untransferred residual toner adhering on the surface of the image bearer, wherein the cleaning blade is the cleaning blade according to [7].

[9] A process cartridge including:

an image bearer; and at least a cleaning means including a cleaning blade configured to remove untransferred residual toner adhering on a surface of the image bearer, the image bearer and the cleaning means being supported in an integrated manner, the process cartridge being attachable in and detachable from a main body of an image forming device, wherein the cleaning blade is the cleaning blade according to [7].

EXAMPLES

Next, the present invention will be described in greater detail by way of Examples conducted by the applicant. The present invention should not be construed as being limited to the Examples.

Unless otherwise expressly specified, "part" represents "part by mass" in the following.

Examples 1 to 14 and Comparative Examples 1 to 4

Elastic Blade Preform

With reference to a method for producing a single-layer cleaning blade described as a referential example in Japanese Unexamined Patent Application Publication No. 2011-141449, a prepolymer was produced in advance using p-MDI (48.56 parts by mass), and PCL210N (polycaprolactone diol produced using straight-chain glycol as an initiator, with a number average particle diameter of 1,000, available from Daicel Corporation) (51.44 parts by mass). The prepolymer, PCL210N (40.82 parts by mass), trimethylolpropane as a crosslinking agent (3.34 parts by mass), and 1,4-butanediol as a chain extender (5.22 parts by mass) were mixed to produce an undiluted polyurethane solution. Using the undiluted polyurethane solution, an elastic blade preform having an average thickness of 1.8 mm and having a strip shape having a size of 11.5 mm×32.6 cm was formed by a centrifugal molding method.

The obtained elastic blade preform had a JIS-A hardness of 68 degrees and an impact resilience of 30%.

Hardness of the elastic blade preform was measured with a micro rubber hardness meter MD-1 available from Kobunshi Keiki Co., Ltd. according to JIS K6253.

Impact resilience of the elastic blade preform was measured with a resilience tester No. 221 available from Toyo Seiki Seisaku-Sho Ltd. according to JIS K6255. A sample was formed of sheets of about 2 [mm] to have a thickness of 4 [mm] or greater.

[Impregnation Material]

Curable compositions 1 to 3 below were used as ultraviolet-curable compositions to be used in an impregnation treatment.

<Curable Material (Impregnation Material) 1>

Ultraviolet-curable resin: tricyclodecane dimethanol diacrylate (available from Shin-Nakamura Chemical Co., Ltd., product name: A-DCP, with 2 functional groups and a molecular weight of 304) (80 parts)

Polymerization initiator: Ciba Specialty Chemicals Inc., IRGACURE 184 (5 parts)

Solvent: cydohexanone (15 parts)

<Curable Material (Impregnation Material) 2>

Ultraviolet-curable resin: 1,3-adamantane dimethanol diacrylate (available from Idemitsu Kosan Co., Ltd., X-A-201, with 2 functional groups and a molecular weight of 304) (50 parts)

Polymerization initiator: Ciba Specialty Chemicals Inc., IRGACURE 184 (5 parts)

Solvent: cydohexanone (45 parts)

<Curable Material (Impregnation Material) 3>

Ultraviolet-curable resin: pentaerythritol triacrylate (available from Daicel-Cytec Company, Ltd., PETIA, with 3 functional groups and a molecular weight of 298) (50 parts)

Polymerization initiator: Ciba Specialty Chemicals Inc., IRGACURE 184 (5 parts)

Solvent: cyclohexanone (45 parts)

A projecting end edge portion, which was to be a part to contact an image bearer, of the elastic blade preform was impregnated with each of the curable materials (impregnation materials) presented in Table 2. An impregnation range was a lower end of the elastic blade including the projecting end edge portion as indicated by reference numeral 62*d* in FIG. 1B. The lower end was immersed in and impregnated with each of the curable materials (impregnation materials) to a depth of 2 mm. The impregnation time was 20 minutes, and impregnation was performed at a temperature of 24° C.

As a step of removing a residue after the impregnation treatment, immersion in a solvent was performed in Examples 1 to 14, wiping with a solvent was performed in Comparative Examples 1 to 3, and dry wiping without a solvent was performed in Comparative Example 4.

[Washing Solvent]

Solvents 1 to 13 below were used as the washing solvents of Examples 1 to 14. The impregnated blade was immersed in the solvents at 24° C. The immersing time was 20 seconds in Examples 1 to 13 and 1 minute in Example 14

<Solvent 1>

Cyclohexane (available from Kanto Kagaku)

The structure is presented below.

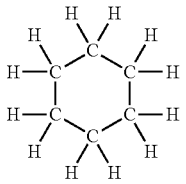

<Solvent 2>

Cyclohexanone (available from Kanto Kagaku)

The structure is presented below.

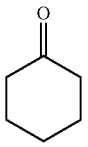

<Solvent 3>

1-Methoxy-2-propanol (available from Kanto Kagaku)

The structure is presented below.

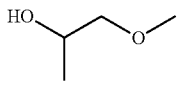

<Solvent 4>

1-Butanol (available from Kanto Kagaku)

The structure is presented below.

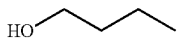

<Solvent 5>

Methyl ethyl ketone (available from Kanto Kagaku)

The structure is presented below.

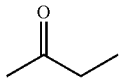

<Solvent 6>

Toluene (available from Kanto Kagaku)

The structure is presented below.

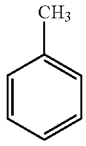

<Solvent 7>

Xylene (available from Kanto Kagaku)

The structure is presented below. (Xylene used was a mixture of ortho, meta, and para forms; the ortho form is presented below.)

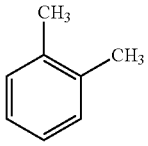

<Solvent 8>

Butyl acetate (available from Kanto Kagaku)

The structure is presented below.

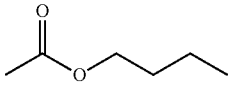

<Solvent 9>

Tetrahydrofuran (available from Kanto Kagaku)

The structure is presented below.

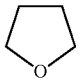

<Solvent 10>

Acetone (available from Kanto Kagaku)

The structure is presented below.

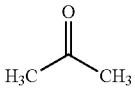

<Solvent 11>

Ethanol (available from Kanto Kagaku)

The structure is presented below.

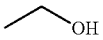

<Solvent 12>

Diethyl ether

The structure is presented below.

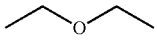

<Solvent 13>

Ethylene glycol

The structure is presented below.

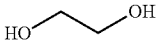

[Wiping Solvent]

Solvents 1 to 3 below were used as the wiping solvents of Comparative Examples 1 to 3. BEMCOT (available from Asahi Kasei Corporation) was soaked with the solvents, and the residue on the impregnated part of the blade was wiped.

<Solvent 1>

Methyl ethyl ketone (available from Kanto Kagaku)

The structure is as presented above.

<Solvent 2>

Toluene (available from Kanto Kagaku)

The structure is as presented above.

<Solvent 3>

Ethanol (available from Kanto Kagaku)

The structure is as presented above.

Characteristic values of the solvents are presented in Table 1.

(Vapor Pressures Presented are MSDS Values of Kanto Kagaku.)

TABLE 1

| Washing solvent | Name | SP value | Viscosity (20° C.) [mPa · s] | Vapor pressure (20° C.) [kPa] |
|---|---|---|---|---|
| 1 | Cyclohexane | 8.2 | 0.98 | 10.4 |
| 2 | Cyclohexanone | 9.9 | 1.78 | 0.5 |
| 3 | 1-methoxy-2-propanol | 10.4 | 1.81 | 1 |

TABLE 1-continued

| Washing solvent | Name | SP value | Viscosity (20° C.) [mPa · s] | Vapor pressure (20° C.) [kPa] |
|---|---|---|---|---|
| 4 | 1-butanol | 11.4 | 3 | 0.6 |
| 5 | Methyl ethyl ketone | 9.3 | 0.4 | 10.5 |
| 6 | Toluene | 8.9 | 0.59 | 3 |
| 7 | Xylene | 8.8 | 0.81 | 0.8 |
| 8 | Butyl acetate | 8.5 | 0.74 | 1.3 |
| 9 | Tetrahydrofuran | 9.1 | 0.49 | 20 |
| 10 | Acetone | 9.9 | 0.32 | 22 |
| 11 | Ethanol | 12.7 | 1.2 | 5.9 |
| 12 | Diethyl ether | 7.4 | 0.24 | 58.6 |
| 13 | Ethylene glycol | 14.2 | 23.5 | 0.07 |

As described, a crosslinked structure of each of the curable materials was formed by a dipping coating method. In Examples 1 to 14, after the elastic blade preform was impregnated with each of the curable materials (impregnation materials) 1 to 3 at 24° C. for 20 minutes, the immersing step was performed specifically by immersion and washing in the washing solvents at 24° C. for 20 seconds (Examples 1 to 13) or for 1 minute (Example 14). After the washing, the solvent remaining on the surface was wiped off with a sponge, and ultraviolet exposure was performed (140 [W/cm]×5 [m/min]×5 passes). Then, drying was performed with a thermal dryer at an internal temperature of the chamber of 100° C. for 15 minutes.

In Comparative Examples 1 to 3, after the impregnation of the curable materials (impregnation materials) 1 and 2 at 24° C. for 20 minutes, a residue on the impregnated part of the blade was wiped in the longer direction of the blade with BEMCOT (available from Asahi Kasei Corporation) soaked with the wiping solvents, and ultraviolet exposure was performed (140 [W/cm]×5 [m/min]×5 passes). Then, drying was performed with a thermal dryer at an internal temperature of the chamber of 100° C. for 15 minutes.

In Comparative Example 4, after the impregnation of the curable material 2 at 24° C. for 20 minutes, a residue on the impregnated part of the blade was wiped in the longer direction of the blade with BEMCOT (available from Asahi Kasei Corporation) that was dry, and ultraviolet exposure was performed (140 [W/cm]×5 [m/min]×5 passes). Then, drying was performed with a thermal dryer at an internal temperature of the chamber of 100° C. for 15 minutes.

Unevenness in the longer direction in Martens hardness measured from surfaces of each obtained elastic blade at positions that were on the horizontal surface and the vertical surface of the impregnated part and were at a distance of 20 [μm] from the projecting end edge portion was measured in a manner described below.

Specifically, a side (i.e., projecting end edge portion), which was to contact an image bearer, of the elastic blade was divided into 5 equal parts, and Martens hardness was measured from the surfaces at 5 positions that were within the 5 equal parts on each of the horizontal surface and the vertical surface of the impregnated part of the elastic blade and were at a distance of 20 μm from the projecting end edge portion (i.e., a total of 10 positions). The value representing the unevenness in Martens hardness in the longer direction was obtained by calculating an average of the 5 positions on each of the horizontal surface and the vertical surface and calculating the maximum deviation from the average in percentage.

The results are presented in Table 2. Hardness unevenness presented in Table 2 is the largest one of the maximum deviations on the horizontal surface and the vertical surface.

Hardness was measured with a microhardness tester FISCHERSCOPE HM2000 available from Fischer Technology Pte. Ltd. with an indenting load of 2 mN applied to the surfaces of the blade at positions at a distance of 20 μm from the projecting end edge portion for an indenting time of 10 s.

Presence or Absence of Residue on Surface of Blade:

Observation with a microscope VHX-100 available from Keyence Corporation was performed to confirm presence or absence, on the surfaces of the blade, of any residue that was suspected to be a coating liquid residue. The following judgment was made.

None: A flat state with no residue at all on the projecting end edge portion

Little: A state of any residue remaining on part of the projecting end edge portion Much: A state of any residue remaining on an entire region of the projecting end edge portion Next, a configuration of an image forming device with which Examples were conducted will be described.

Each obtained elastic blade was secured with an adhesive to a sheet metal holder that was mountable on a color multifunction peripheral IMAGIO MP C5001 available from Ricoh Company, Ltd., to be used as a prototype cleaning blade. This was attached in the same color multifunction peripheral IMAGIO MP C5001 (having the same configuration as in FIG. 2) available from Ricoh Company, Ltd., to produce image forming devices of Examples 1 to 14 and Comparative Examples 1 to 4. The cleaning blade was attached at a linear pressure and a cleaning angle that were set based on a predetermined projecting end biting amount and a predetermined attaching angle. A lubricant coating device was removed.

For evaluation, a toner produced by a polymerization method was used. Physical properties of the toner are as follows.

Toner base:

a circularity of 0.98 an average particle diameter of 4.9 [μm]

External additives:

small particle diameter silica (1.5 parts) (H2000 available from Clariant AG)

small particle diameter titanium oxide (0.5 parts) (MT-150AI available from Tayca Corporation)

large particle diameter silica (1.0 part) (UFP-30H available from Denka Company Limited)

The blending amounts of the external additives are blending amounts relative to 100 parts of the toner base.

Evaluation was performed in a laboratory environment of 21 [° C.] and 65 [% RH] under paper sheet passing conditions: a chart having an image occupation rate of 5% at 3 prints/job on 10,000 sheets (A4 lateral).

[Evaluation Items]

Image for Evaluation:

a chart having a pattern of vertical bands (in a paper sheet moving direction) including three bands with a width of 43 [mm].

output on 20 sheets (A4 lateral)

Evaluation of Slip-Through of Toner:

Immediately after the cleaning blade was applied, presence or absence of the toner, etc. on the surface of the photoconductor was checked by transfer to a tape, and the following judgment was made. Evaluation was performed after the image mentioned above was output on 20 sheets in an initial period (which was after outputting on 10 sheets), and also performed after the image mentioned above was output on 20 sheets after outputting on 10,000 sheets.

A: There was no slip-through both in the initial period of evaluation and after outputting on 10,000 sheets.

B: There was no slip-through in the initial period of evaluation, but there was slip-through after outputting on 10,000 sheets.

C: There was slip-through in the initial period of evaluation.

Cleaning Failure on Image:

After outputting on 10,000 sheets, the image for evaluation having a pattern of vertical bands (in a paper sheet moving direction) including three bands with a width of 43 mm (with an A4 size laterally) was output, and an output image after outputting on 20 sheets was visually observed to evaluate cleanability according to the criteria below. An abnormal image means an image appearing in a streak shape or a band shape on a printed image or a white spot image.

A: There was no abnormal image.

C: There was an abnormal image.

Evaluation results of Examples and Comparative Examples are presented in Table 2.

TABLE 2

| | Impregnation material | Washing solvent | Wiping solvent | Hardness unevenness [%] | Residue on surface | Slip-through of toner | Cleaning failure on image |
|---|---|---|---|---|---|---|---|
| Ex. 1 | 1 | 1 | — | 5 | None | A | A |
| Ex. 2 | 2 | 2 | — | 5 | None | A | A |
| Ex. 3 | 3 | 3 | — | 10 | None | A | A |
| Ex. 4 | 1 | 4 | — | 10 | None | A | A |
| Ex. 5 | 1 | 5 | — | 15 | None | A | A |
| Ex. 6 | 2 | 6 | — | 25 | None | A | A |
| Ex. 7 | 2 | 7 | — | 10 | None | A | A |
| Ex. 8 | 3 | 8 | — | 10 | None | A | A |
| Ex. 9 | 3 | 9 | — | 35 | None | B | A |
| Ex. 10 | 1 | 10 | — | 35 | None | B | A |
| Ex. 11 | 1 | 11 | — | 10 | Little | B | A |
| Ex. 12 | 1 | 12 | — | 20 | Little | B | A |
| Ex. 13 | 1 | 13 | — | 30 | Little | B | A |
| Ex. 14 | 1 | 1 | — | 5 | None | B | A |
| Comp. Ex. 1 | 1 | — | 1 | 50 | None | C | C |
| Comp. Ex. 2 | 1 | — | 2 | 45 | None | C | C |
| Comp. Ex. 3 | 2 | — | 3 | 50 | Little | C | C |
| Comp. Ex. 4 | 2 | — | Dry wiping | 70 | Much | C | C |

From the results of Table 2, in the present invention, it was confirmed that hardness unevenness in the longer direction of the blade was greatly reduced when the step of removing a residue on the surface of the part, which was to contact an image bearer, of the elastic blade preform after impregnation of the ultraviolet-curable composition was performed by immersing in a washing solvent instead of wiping with a solvent. It was also confirmed that a washing solvent having a SP value of 8.0 or greater but 11.5 or less had a good compatibility with the (meth)acrylate compound and could wash the surface without a residue. Furthermore, it was revealed that use of a solvent having a viscosity of 0.9 [mPa·s] or greater and a vapor pressure of 15 [kPa] or less at 20° C. and having a ring structure resulted in suppression of extraction of the impregnated ultraviolet-curable composition and further reduction in hardness unevenness. An immersing time for washing of 1 minute was considered to reduce hardness and cause slight slip-through of toner, but an immersing time of 20 seconds could ensure a high hardness and suppression of hardness unevenness.

DESCRIPTION OF THE REFERENCE NUMERAL

| | |
|---|---|
| 1K | process unit (black) |
| 1C | process unit (cyan) |
| 1M | process unit (magenta) |
| 1Y | process unit (yellow) |
| 2 | image bearer (photoconductor) |
| 3 | cleaning means |
| 4 | charging means |
| 5 | developing means (developing roller) |
| 6 | toner storing section |
| 7 | exposing device |
| 8 | transfer belt device |
| 9 | primary transfer roller |
| 10 | driving roller |
| 11 | tension roller |
| 12 | intermediate transfer belt |
| 13 | secondary transfer roller |
| 14 | belt cleaning device |

-continued

| | |
|---|---|
| 15 | cleaning backup roller |
| 16 | paper feeding cassette |
| 17 | paper feeding roller |
| 18 | pair of registration rollers |
| 19 | fixing device |
| 20 | pair of paper ejecting rollers |
| 21 | paper ejecting tray |
| 22 | waste toner storing vessel |
| 23 | housing |
| 25 | fixing roller |
| 26 | pressure roller |
| 62 | cleaning blade |
| 62a | projecting end surface (horizontal surface) |
| 62b | vertical surface on projecting end edge portion |
| 62c | projecting end edge portion |
| 62d | impregnation range |
| 123 | image bearer |
| 621 | holder |
| 622 | elastic blade |

The invention claimed is:

1. A method for producing a cleaning blade that comprises a strip-shaped elastic blade having a projecting end edge portion for contacting an image bearer, the method comprising:

a step (a) of producing an elastic blade preform formed of a polyurethane rubber;

a step (b) of impregnating each surface of an end part, which corresponds to the projecting end edge portion of the elastic blade to contact the image bearer, of the elastic blade preform, in an impregnation distance in a range of 1 cm or less in an inward direction from the surface, with an ultraviolet-curable composition that comprises a (meth)acrylate compound, wherein the impregnated end part does not include all of the surfaces of the elastic blade;

a step (c) of immersing the end part of the elastic blade preform, impregnated in step (b), in a washing solvent for an immersing duration in a range from 1 second to 1 minute, to remove the ultraviolet-curable composition that comprises the (meth)acrylate compound and remains on a surface of the end part impregnated; and a step (d) of curing the ultraviolet-curable composition that comprises the (meth)acrylate compound and has impregnated the elastic blade preform to produce an elastic blade.

2. The method for producing a cleaning blade according to claim 1, wherein the washing solvent used in the step (c) has a SP value of 8.0 or greater but 11.5 or less.

3. The method for producing a cleaning blade according to claim 1, wherein the washing solvent used in the step (c) has a viscosity of 0.9 [mPa·s] or greater at 20° C.

4. The method for producing a cleaning blade according to claim 1, wherein the washing solvent used in the step (c) has a vapor pressure of 15 [kPa] or less at 20° C.

5. The method for producing a cleaning blade according to claim 1, wherein the washing solvent used in the step (c) comprises a compound having a ring structure.

6. The method for producing a cleaning blade according to claim 1, wherein the immersing duration for which the part of the cleaning blade impregnated of the elastic blade preform is immersed in the washing solvent in the step (c) is in a range from 1 second to 20 seconds.

* * * * *